US008872733B2

(12) United States Patent
Yoshimura

(10) Patent No.: US 8,872,733 B2
(45) Date of Patent: Oct. 28, 2014

(54) LIQUID CRYSTAL DISPLAY DEVICE, MULTI-DISPLAY DEVICE, METHOD FOR DETERMINING LIGHT INTENSITY, AND STORAGE MEDIUM

(75) Inventor: Hideyoshi Yoshimura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 283 days.

(21) Appl. No.: 13/447,408

(22) Filed: Apr. 16, 2012

(65) Prior Publication Data

US 2012/0268350 A1 Oct. 25, 2012

(30) Foreign Application Priority Data

Apr. 20, 2011 (JP) ..... 2011-094535

(51) Int. Cl.
*G09G 5/12* (2006.01)
*G09G 3/34* (2006.01)

(52) U.S. Cl.
CPC ..... *G09G 3/3426* (2013.01); *G09G 2320/0646* (2013.01); *G09G 2300/026* (2013.01); *G09G 2360/16* (2013.01)
USPC ..... 345/1.3; 345/102

(58) Field of Classification Search
CPC ..... G09G 3/3426; G09G 2300/026; G09G 2300/0238
USPC ..... 345/102, 1.1, 1.3
See application file for complete search history.

(56) References Cited

U.S. PATENT DOCUMENTS

| | | | | |
|---|---|---|---|---|
| 2010/0007819 | A1 | 1/2010 | Kumasaka et al. | |
| 2010/0220048 | A1 | 9/2010 | Yamamura et al. | |
| 2010/0328336 | A1 * | 12/2010 | Si | 345/102 |
| 2012/0105507 | A1 * | 5/2012 | An et al. | 345/102 |

FOREIGN PATENT DOCUMENTS

| | | | |
|---|---|---|---|
| JP | 2-273790 | A | 11/1990 |
| JP | H06-095139 | A | 4/1994 |
| JP | 2728494 | B2 | 12/1997 |
| JP | 2001-188481 | A | 7/2001 |
| JP | 2007-279395 | A | 10/2007 |
| JP | 2009-169196 | A | 7/2009 |
| JP | 2010-020961 | A | 1/2010 |
| WO | WO 2010150974 | A2 * | 12/2010 |

* cited by examiner

*Primary Examiner* — Allison W Johnson
(74) *Attorney, Agent, or Firm* — Renner, Otto, Boisselle & Sklar, LLP

(57) ABSTRACT

The liquid crystal display device 30, included in the multi-display device 1, includes (i) a receiving section 21 for receiving display image data indicative of a display image to be displayed on a display panel 11 of the liquid crystal display device 30 and (ii) a light intensity determining section 22 for determining light intensity for each of segments of a backlight device 12 of the liquid crystal display device 30. When the receiving section 21 receives peripheral display image data, which is indicative of a peripheral image contiguous to the display image, the light intensity determining section 22 determines the light intensities of the respective segments based on the display image data and the peripheral display image data.

9 Claims, 12 Drawing Sheets

FIG. 5

| | x−3 | x−2 | x−1 | x | x+1 | x+2 | x+3 |
|---|---|---|---|---|---|---|---|
| y−3 | 0 | 0 | 0 | 0 | 0 | 0 | 0 |
| y−2 | 0 | 2 | 7 | 12 | 7 | 2 | 0 |
| y−1 | 1 | 15 | 71 | 120 | 71 | 15 | 1 |
| y | 2 | 32 | 152 | 255 | 152 | 32 | 2 |
| y+1 | 1 | 15 | 71 | 120 | 71 | 15 | 1 |
| y+2 | 0 | 2 | 7 | 12 | 7 | 2 | 0 |
| y+3 | 0 | 0 | 0 | 0 | 0 | 0 | 0 |

FIG. 6

| | x−3 | x−2 | x−1 | x | x+1 | x+2 | x+3 |
|---|---|---|---|---|---|---|---|
| y−3 | 0 | 0 | 0 | 0 | 0 | 0 | 0 |
| y−2 | 0 | 0 | 2 | 3 | 2 | 0 | 0 |
| y−1 | 0 | 4 | 18 | 30 | 18 | 4 | 0 |
| y | 1 | 8 | 38 | 64 | 38 | 8 | 1 |
| y+1 | 0 | 4 | 18 | 30 | 18 | 4 | 0 |
| y+2 | 0 | 0 | 2 | 3 | 2 | 0 | 0 |
| y+3 | 0 | 0 | 0 | 0 | 0 | 0 | 0 |

FIG. 7

| | x−3 | x−2 | x−1 | x | x+1 | x+2 | x+3 |
|---|---|---|---|---|---|---|---|
| y−3 | 0 | 0 | 0 | 0 | 0 | 0 | 0 |
| y−2 | 0 | 2/a | 7/a | 12/a | 7/a | 2/a | 0 |
| y−1 | 1/a | 15/a | 71/a | 120/a | 71/a | 15/a | 1/a |
| y | 2/a | 32/a | 152/a | 255/a | 152/a | 32/a | 2/a |
| y+1 | 1/a | 15/a | 71/a | 120/a | 71/a | 15/a | 1/a |
| y+2 | 0 | 2/a | 7/a | 12/a | 7/a | 2/a | 0 |
| y+3 | 0 | 0 | 0 | 0 | 0 | 0 | 0 |

LIQUID CRYSTAL DISPLAY DEVICE, MULTI-DISPLAY DEVICE, METHOD FOR DETERMINING LIGHT INTENSITY, AND STORAGE MEDIUM

This Nonprovisional application Claims priority under 35 U.S.C. §119 on Patent Application No. 2011-094535 filed in Japan on Apr. 20, 2011, the entire contents of which are hereby incorporated by reference.

TECHNICAL FIELD

The present invention relates to a liquid crystal display device and the like for use in a multi-display device, in which a plurality of liquid crystal display devices are adjacently arranged so as to display a large screen.

BACKGROUND ART

Conventionally, transmissive liquid crystal display devices are known as image display means. The transmissive liquid crystal display device is provided with a non-self-luminous liquid crystal panel and thus requires a backlight device. In such a backlight device, a cold cathode fluorescent lamp (CCFL) has been used as a light source. Recently, however, a backlight device including a LED as a light source is widely used, which is free from disadvantages of a cold cathode fluorescent lamp, such as environmental pollution caused by mercury, or slower response speed. In addition to solving the disadvantages of a cold cathode fluorescent lamp, the backlight device including a LED as a light source can also achieve a partial drive such as local dimming to improve a contrast ratio of an image. The local dimming will be described below.

The "local dimming" is a process in which (i) a backlight device is divided into segments (blocks) each having its light source and (ii) a light intensity of each of the segments is adjusted based on a luminance component of an image to be displayed in a corresponding area of a liquid crystal panel, which corresponding area is irradiated with light emitted from the segment. That is, in the liquid crystal display device which employs local dimming, a light intensity of a segment corresponding to an area displaying a bright image can be increased, whereas a light intensity of a segment corresponding to an area displaying a dark image can be decreased. The liquid crystal display device which employs local dimming can thus display an image of a higher contrast ratio in which a bright image displaying area is displayed brighter and a dark image displaying area is displayed darker.

However, the liquid crystal display device which employs local dimming has a disadvantage described below, in a case where, for example, one area displaying white and black images and another area displaying only a black image are adjacent to each other. That is, a light intensity of a segment corresponding to the area displaying white and black images is adjusted to a value in accordance with the white image (with high luminance), whereas a light intensity of a segment corresponding to the area displaying only a black image is adjusted to a value in accordance with the black image (with low luminance). This leads to a difference in brightness of displayed black between one area and another area, resulting in an unnaturally-appearing image being displayed in which a boundary between the areas is conspicuous.

In order to avoid such a disadvantage, a liquid crystal display device has been proposed, in which light intensities of respective segments are determined by (i) calculating light intensities of the respective segments on the basis of a local dimming technique and then (ii) correcting the light intensities of the respective segments so that no segment has a light intensity differing greatly from those of adjacent segments. As an example, Patent Literature 1 discloses a technique in which a luminance is gradually changed for each of adjacent areas.

Meanwhile, multi-display devices, each of which includes a plurality of image displaying means set in array, have been widely used. Such multi-display devices encompass a multi-display device of screen projection type as follows: Patent Literature 2 discloses a technique to prevent light emitted by one of adjacent projectors from being displayed on a screen corresponding to the other of the adjacent projectors, so that adjustment between screens can be easily carried out. Patent Literature 3 discloses a technique in which (i) enlarged images for respective of a plurality of displays are projected such that the enlarged images partially overlap each other, and (ii) a luminance of an overlap image area and a luminance of a non-overlap image area are controlled to be equal to each other so as to eliminate a difference in luminance in the overlap part. Patent Literature 4 discloses a technique in which (i) an original image is divided into a plurality of areas and (ii) a projection image corresponding to the original image is obtained on a single screen by combining images of the respective plurality of areas while partially overlapping adjacent images.

CITATION LIST

Patent Literature

Patent Literature 1
Japanese Patent Application Publication Tokukai No. 2010-020961 A (Publication date: Jan. 28, 2010)
Patent Literature 2
Japanese Patent Application Publication Tokukai No. 2001-188481 A (Publication date: Jul. 10, 2001)
Patent Literature 3
Japanese Patent Application Publication Tokukaihei No. 6-95139 A (Publication date: Apr. 8, 1994)
Patent Literature 4
Japanese Patent Application Publication Tokukaihei No. 2-273790 A (Publication date: Nov. 8, 1990)

SUMMARY OF INVENTION

Technical Problem

Conventionally, the technique based on the local dimming, in which light intensities are determined by calculating light intensities of respective segments and by correcting the light intensities, has been directed to a device having a single liquid crystal display. Therefore, in a case where the technique based on the local dimming is used in a multi-display device including a plurality of liquid crystal display devices set in array, there occurs a problem described below.

In the case where the plurality of liquid crystal display devices are used to constitute the multi-display device, each of the plurality of liquid crystal display devices determines light intensities of respective segments in the liquid crystal display device by (i) calculating light intensities of the respective segments by referring to data of an image to be displayed by the liquid crystal display device itself and then (ii) correcting the calculated light intensities of the respective segments such that light intensities of adjacent segments do not excessively differ from each other.

The following discusses a case where, for example, an image of a light-emitting object (which is a ball having high luminance) in the dark is displayed on a display panel of an upper left one of four liquid crystal display devices, which are arranged in a matrix of 2×2 and constitute a multi-display device (see FIG. 15). In this case, the light-emitting object is displayed in the vicinity of bezels 111 (hereinafter, referred to as "panel border bezel 111") corresponding to borders between display panels of the respective four liquid crystal display devices. In the upper left liquid crystal display device, light intensities of respective segments are determined (calculated and corrected) by taking into consideration the image of the light-emitting object. On the other hand, in each of the other liquid crystal display devices (of upper right, lower right, and lower left), light intensities of respective segments are not determined by taking into consideration the image of the light-emitting object. Under the circumstances, in the display panel displaying the light-emitting object, afterglow in a black display (so-called "floating black level") is caused by light which is leaked even though the light is shielded by liquid crystal around the light-emitting object. Whereas, in each of the other display panels not displaying the light-emitting object, such floating black level is not viewed because light in the segments in back of the display panel thereof is completely turned off. On both sides of the panel border bezel 111, therefore, difference becomes undesirably noticeable between an area showing the floating black level and another area showing no floating black level.

As above described, the multi-display device which carries out the conventional local dimming has a problem that the multi-display device as a whole displays an image that appears unnatural.

Note that the techniques disclosed in Patent Literatures 2 through 4 are related to a multi-display device of a screen-projection type, and accordingly no local dimming is carried out. Therefore, the techniques disclosed in Patent Literatures 2 through 4 cannot solve the problem of a multi-display device having a plurality of liquid crystal display devices.

The present invention is accomplished in view of the problem, and an object of the present invention is to provide a liquid crystal display device for use in a multi-display device made up of a plurality of liquid crystal display devices set in array, which liquid crystal display device allows (i) suppression of electric power consumption and (ii) prevention of the multi-display device as a whole from displaying an image that appears unnatural.

Solution to Problem

In order to attain the object, a liquid crystal display device of the present invention is a liquid crystal display device for use in a multi-display device made up of a plurality of liquid crystal display devices set in array, the liquid crystal display device includes: a display panel for displaying an image; a backlight device which is provided in back of the display panel and is divided into segments having respective light sources, the backlight device being capable of illuminating at a light intensity adjustable for each of the segments; a receiving section for receiving image data indicative of an image to be displayed on the display panel; and a light intensity determining section for determining a light intensity at which the backlight device illuminates for each of the segments of the backlight device, in a case where the receiving section receives peripheral display image data, the light intensity determining section determining the light intensity of each of the segments based on the image data and the peripheral display image data, the peripheral display image data being indicative of an image, which (i) is contiguous to the image to be displayed on the display panel and (ii) is to be displayed on at least part of a display panel of a liquid crystal display device provided around the liquid crystal display device among the plurality of liquid crystal display devices for use in the multi-display device.

Advantageous Effects of Invention

With the configuration, it is possible to determine light intensities such that a difference of light intensities does not become too large (i) between adjacent segments in one (1) liquid crystal display device or (ii) between adjacent segments across adjacent liquid crystal display devices. In a case where, for example, (i) a first liquid crystal display device and a second liquid crystal display device are adjacent to each other and (ii) an object with high luminance is contained in an image which is indicated by peripheral display image data and is displayed on a display panel of the second liquid crystal display device, light intensities of respective segments of a backlight device included in the first liquid crystal display device can be determined such that a floating black level around the object with high luminance does not become conspicuous.

This makes it possible to reduce a risk that a large difference in brightness occurs (i) between adjacent areas in a display panel of one (1) liquid crystal display device or (ii) between adjacent areas across display panels of liquid crystal display devices adjacent to each other, even in a case where the adjacent areas, which face respective segments adjacent to each other, display respective partial images having identical or similar averages, etc. of luminance components. This prevents the multi-display device, in which the plurality of liquid crystal display devices are set in array, from displaying an image that appears unnatural.

According to the configuration, light can be emitted from only necessary segments. This allows suppression of an increase in average electric power consumption, as compared to a case where a background luminance is maintained by causing at least segments to emit light in the vicinity of panel border bezels as early described. Moreover, even in the vicinity of the panel border bezels, it is possible to cause (i) an area for displaying a bright image to be brighter and (ii) another area for displaying a dark image to be darker. It is therefore possible to display an image with a higher contrast ratio of bright and dark, as compared to the case where the background luminance in the vicinity of the panel border bezels is maintained.

Moreover, according to the configuration of the present invention, it is not necessary to maintain the background luminance by causing the segments to emit light in the vicinity of the panel border bezels, unlike the case where a background luminance is maintained by causing the segments to slightly emit light in the vicinity of the panel border bezels. With the configuration, electric power can be consumed by segments (whose number is smaller than that of the segments in the vicinity of the panel border bezels) for emitting light at maximum output, instead of being consumed for maintaining the background luminance. Therefore, in a case where a peak luminance increasing control is carried out for causing part of the segments to emit light with a luminance higher than that of light emitted by all the segments, it is possible to further heighten the peak luminance with the same electric power consumption as a case where such a peak luminance increasing control is carried out while maintaining the background luminance.

BRIEF DESCRIPTION OF DRAWINGS

FIG. 5 is a view illustrating an example of minimum light intensities of respective of a target segment and peripheral segments, in a case where a necessary light intensity of the target segment is 255.

FIG. 6 is a view illustrating an example of minimum light intensities of respective of a target segment and peripheral segments, in a case where a necessary light intensity of the target segment is 64.

FIG. 7 is a view illustrating an example of coefficients used to carry out a convolution operation.

FIG. 10 (*b*) is a view for explaining a case where virtual segments cannot be set in a received extended image, when a light intensity of a target segment is determined.

DESCRIPTION OF EMBODIMENTS

The following description will discuss a configuration of a multi-display device of the present embodiment and processes carried out in the multi-display device, with reference to FIGS. 1 through 14.

(Configurations of Liquid Crystal Display Device and Multi-display Device)

Figure 1:
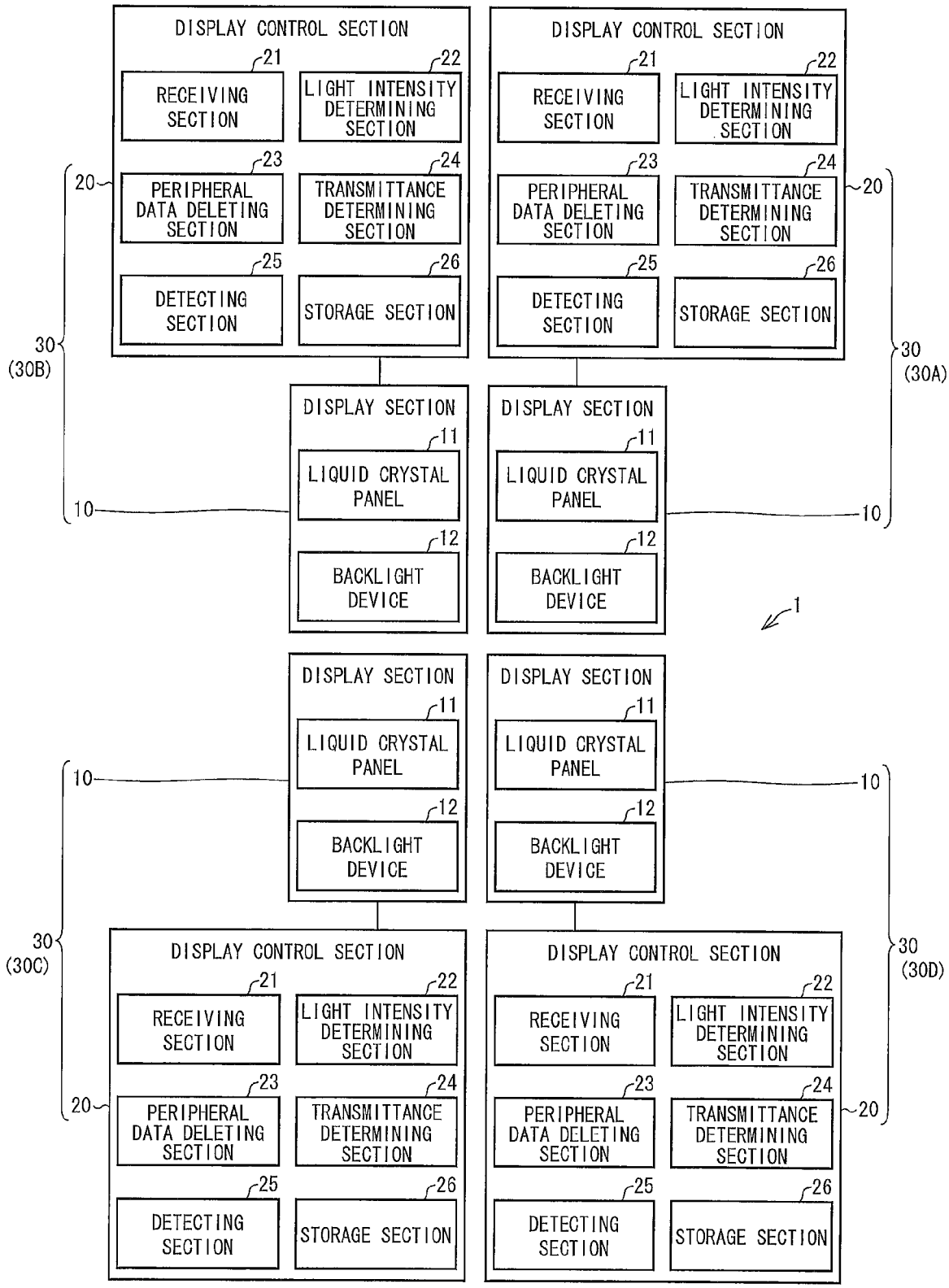
FIG. 1 is a block diagram illustrating a multi-display device of an embodiment of the present invention.

A multi-display device 1 of the present embodiment includes four liquid crystal display devices 30 (see FIG. 1). The four liquid crystal display devices 30 include respective liquid crystal panels 11, and the liquid crystal panels 11 are arranged in a matrix of 2×2 in the multi-display device 1. Note that the number of the liquid crystal display devices 30 is not limited to four, and therefore the present embodiment is suitably applicable to a multi-display device 1 including at least two liquid crystal display devices 30.

In the descriptions below, in a case where the four liquid crystal display devices 30 are distinguishingly referred to, symbols "30A", "30B", "30C", and "30D" are given to the respective four liquid crystal display devices 30. The liquid crystal display devices 30A through 30D have identical configurations, and therefore the same numerals are given to the same constituent members of each of the liquid crystal display devices 30A through 30D. Note, however, that, in a case where the same constituent members are distinguishingly referred to for each of the liquid crystal display devices 30A through 30D, symbols A through D are given to also the corresponding constituent members. In a case where the four liquid crystal display devices 30 are referred to not-distinguishingly from each other in the descriptions below, a term "liquid crystal display device 30" is used to mean a representative one of the four liquid crystal display devices 30.

The liquid crystal display device 30 is a transmissive liquid crystal display device and includes (i) a display section 10 made up of a liquid crystal panel (display panel) 11 and a backlight device 12 and (ii) a display control section 20 for controlling the display section 10. Note that, in the descriptions below, it is assumed that a display control section 20 included in a liquid crystal display device 30 is configured to control a display section 10 included in the same liquid crystal display device 30, even though not specifically described as such. Further, it is also assumed that each block of the display control section 20 carries out a process for the liquid crystal display device 30 in which the display control section 20 is included.

Figure 2:
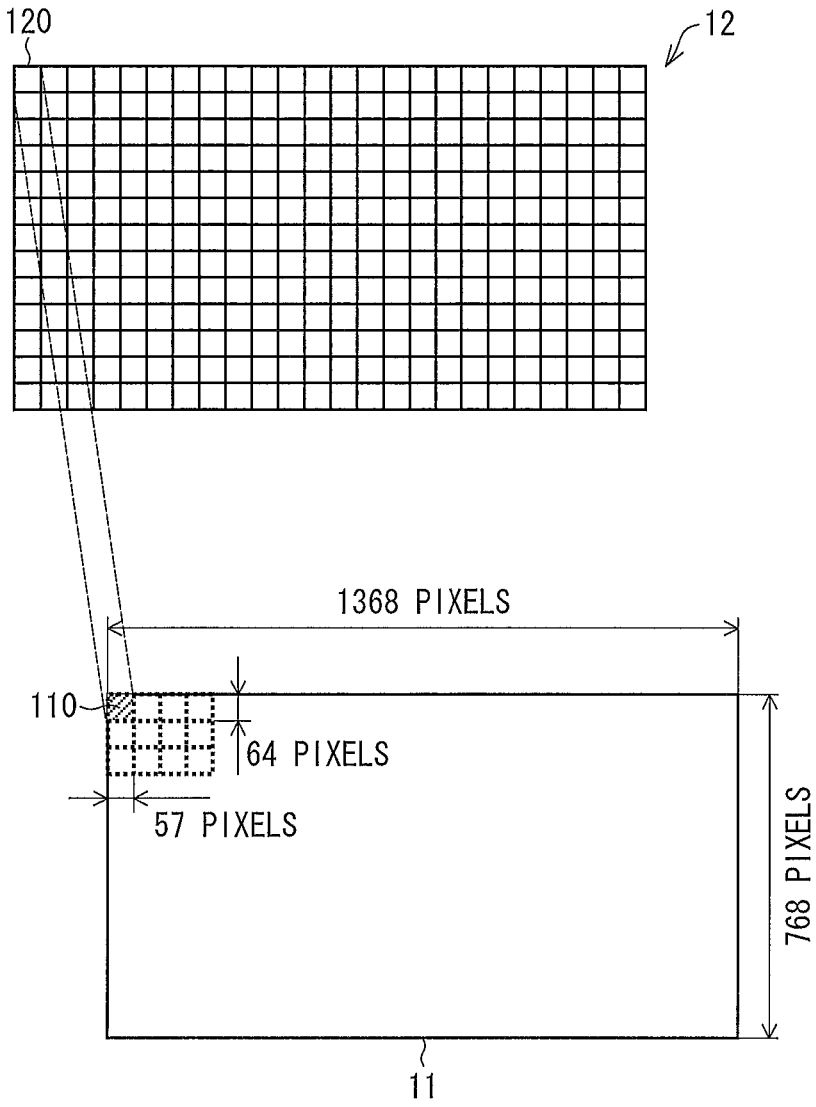
FIG. 2 is a plane view illustrating a liquid crystal panel and a backlight device having segments.

The liquid crystal panel 11 of the present embodiment has horizontal 1368 pixels×vertical 768 pixels (see FIG. 2).

The backlight device 12 is a direct illumination device, which is provided in back of the liquid crystal panel 11 so as to irradiate the liquid crystal panel 11 with light. The backlight device 12 is divided into segments 120 having respective light sources (see FIG. 2). In the present embodiment, the backlight device 12 is divided into horizontal 24 segments× vertical 12 segments, i.e., 288 segments 120. In the liquid crystal display device 30, light intensities of the respective segments 120 can be determined. That is, a light intensity control in a local dimming process is carried out for each of the segments 120.

The segments 120 are arranged in a uniform matrix manner with respect to the entire liquid crystal panel 11 (see FIG. 2). Each of the segments 120 faces (corresponds to) an area of horizontal 57 pixels×vertical 64 pixels. In other words, the area of horizontal 57 pixels×vertical 64 pixels belongs to one (1) segment 120. Hereinafter, the area of horizontal 57 pixels×vertical 64 pixels facing the one (1) segment 120 is referred to as "area 110". The areas 110 correspond to the respective segments 120. That is, the liquid crystal panel 11 is divided into the areas 110, whose number is the same as the number (i.e., 288 in the present embodiment) of the segments 120.

Note that the number of the pixels in the liquid crystal panel 11, the number of the segments in the backlight device 12, and the number of the pixels belonging to one (1) segment 120, are described merely as an example. Therefore, those numbers are not limited to the numbers above described.

Figure 3:
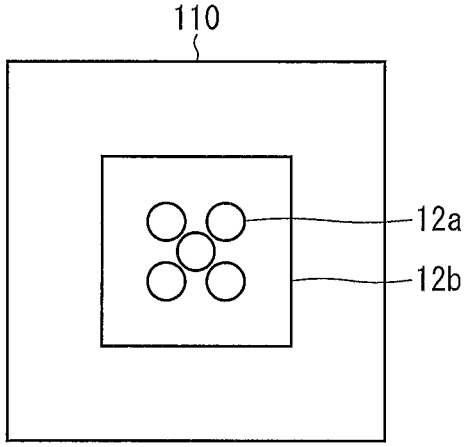
FIG. 3 is a plane view illustrating a single segment.

Each of the segments 120 includes (i) a light source 12*a* made up of five white LEDs (light emitting diodes) and (ii) a substrate 12*b* on which the light source 12*a* is mounted (see FIG. 3). With the configuration, each of the segments 120 serves as a backlight. In the present embodiment, one (1) segment 120 includes the five white LEDs as the light source 12*a*. Note, however, that the number of the LEDs is not limited to five. The light source 12*a* is driven by a light source driver (not illustrated), and a light intensity of the light source 12*a* is adjusted by modulating (i) a pulse width of a driving electric current and (ii) an amount of the driving electric current.

As is clear from the description above, a light intensity of the segment 120 indicates a light intensity of the light source 12*a* provided in the segment 120. Moreover, a phrase "the segment 120 is turned on" means that the light source 12*a* provided in the segment 120 is turned on.

The display control section 20 is a block for controlling the display section 10 of the liquid crystal display device 30. The display control section 20 includes a receiving section 21, a light intensity determining section 22, a peripheral data deleting section 23, a transmittance determining section 24, a detecting section 25, and a storage section 26 (see FIG. 1).

The receiving section 21 is a block for carrying out a receiving step for receiving data of an image, which has been externally supplied and is to be displayed on the liquid crystal panel 11 of the liquid crystal display device 30. Hereinafter, the image displayed on the liquid crystal panel 11 is referred to as "display image" and the data of the display image is referred to as "display image data". Moreover, the receiving section 21 processes the received image data so that the received image data accords with a resolution of the liquid crystal panel 11.

The light intensity determining section 22 is a block for carrying out a light intensity determining step for determining light intensities of the respective segments 120 of the backlight device 12 included in the liquid crystal display device 30.

Here, in a case where the receiving section 21 receives peripheral display image data, the light intensity determining section 22 determines light intensities of the respective segments 120 based on the display image data and the peripheral display image data. Note that the peripheral display image is a data indicative of an image (hereinafter, referred to as "peripheral display image") to be displayed in at least part of a liquid crystal panel 11 of another liquid crystal display device 30, which is provided in the multi-display device 1 and located around the liquid crystal display device 30 including that receiving section 21.

Figure 12:
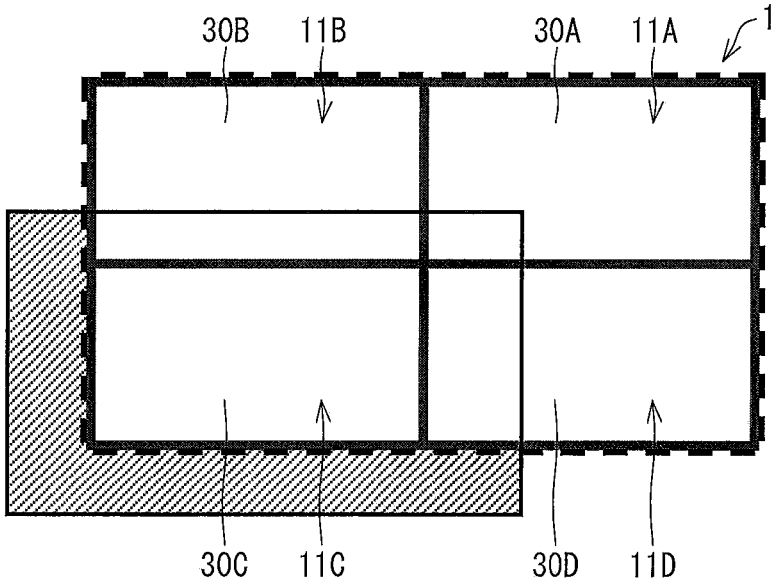
FIG. 12 is a view for explaining a relation between a liquid crystal panel, a display image displayed on the liquid crystal panel, and a peripheral image containing a peripheral display image and a peripheral non-display image.
Figure 13:
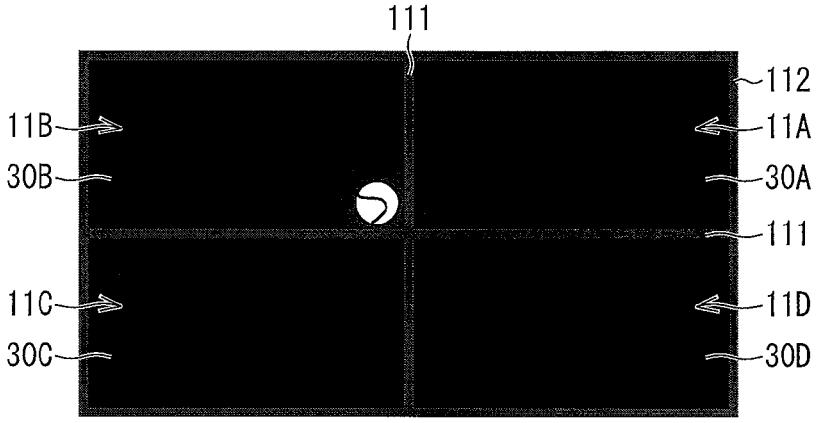
FIG. 13 is a view illustrating an example in which an image of a light-emitting object is displayed by a multi-display device of an embodiment of the present invention.

The following describes a process of determining the light intensities, with reference to FIG. 12. In FIG. 12, an outer frame of the multi-display device 1 is indicated by a dotted line, and outer frames of liquid crystal panels 11A through 11D of the respective liquid crystal display devices 30A through 30D are indicated by thick lines. The following description will discuss a case of the liquid crystal display device 30C. The receiving section 21C receives display image data to be displayed on the liquid crystal panel 11C and data of a peripheral image around the display image. Hereinafter, the data of the peripheral image is referred to as "peripheral image data", and an image made up of the display image and the peripheral image is referred to as "extended image". In FIG. 12, the extended image is indicated as an area outlined by a thin line. The peripheral image is an image contiguous to the display image displayed on the liquid crystal panel 11C, and contains (i) peripheral display images to be displayed on the respective liquid crystal panels 11A, 11B, and 11D of the liquid crystal display devices 30A, 30B, and 30D located around the liquid crystal display device 30C and (ii) a peripheral non-display image (shaded by oblique lines in FIG. 12) which is not displayed by the multi-display device 1. The light intensity determining section 22C determines light intensities of respective segments 120 in the liquid crystal display device 30C based on the display image data and the peripheral display image data.

As such, the liquid crystal display device 30 determines light intensities of the respective segments 120 by the use of the display image data and the peripheral display image data. The peripheral display image data is data of an image which (i) is contiguous to the display image displayed on the liquid crystal panel 11 of the liquid crystal display device 30 and (ii) is to be displayed in at least part of the other liquid crystal panels 11 of the other liquid crystal display devices 30, which are provided in the multi-display device 1 and located around that liquid crystal display device 30. This allows determination of the light intensities such that a difference in light intensity does not become too large (i) between adjacent segments 120 in one (1) liquid crystal display device 30 or (ii) between adjacent segments 120 across liquid crystal display devices 30 adjacent to each other. In a case where, for example, a light-emitting object 3 (which is an image having high luminance) resides in a peripheral display image displayed on the liquid crystal panel 11B of the liquid crystal display device 30B (see FIG. 13), it is possible to determine light intensities of respective segments 120 of the backlight device 12C of the liquid crystal display device 30C such that a floating black level around the light-emitting object 3 does not become conspicuous. In each of the liquid crystal display devices 30A, 30B, and 30D, similarly, light intensities of segments 120 are determined based on corresponding display image data and corresponding peripheral display image data.

This makes it possible to suppress a large difference in brightness (i) between adjacent areas 110 of a liquid crystal panel 11 included in one (1) liquid crystal display device 30 or (ii) between adjacent areas 110 across liquid crystal panels 11 included in respective liquid crystal display devices 30 adjacent to each other, even in a case where the adjacent areas 110, which face respective segments 120 adjacent to each other, display respective partial images having identical or similar averages, etc. of luminance components. This prevents the multi-display device 1, in which the plurality of liquid crystal display devices 30 are set in array, from displaying an image that appears unnatural.

In the liquid crystal display device 30 of the present embodiment, light can be emitted by only necessary segments 120. This allows suppression of average electric power consumption of the multi-display device 1, as compared to a case where a background luminance is maintained by causing at least segments 120 to emit light in the vicinity of bezels (panel border bezels) 111 corresponding to borders between the liquid crystal panels 11 (see FIG. 14). Moreover, even in the vicinity of the panel border bezels 111, it is possible to cause (i) an area 110 for displaying a bright image to be brighter and (ii) another area 110 for displaying a dark image to be darker. It is therefore possible to display an image with a higher contrast ratio of bright and dark, as compared to the case where the background luminance in the vicinity of the panel border bezels 111 is maintained.

Moreover, according to the liquid crystal display device 30 of the present embodiment, it is not necessary to maintain the background luminance by causing segments to emit light in the vicinity of the panel border bezels 111, unlike the case where a background luminance is maintained by causing the segments to slightly emit light in the vicinity of the panel border bezels 111. With the configuration, electric power otherwise consumed for maintaining the background luminance can be consumed by segments 120 (whose number is smaller than that of the segments in the vicinity of the panel border bezels 111) for emitting light at maximum output. Therefore, in a case where a peak luminance increasing control is carried out for causing a part of the segments 120 to emit light with a luminance higher than that of light emitted by all the segments 120, it is possible to further heighten the peak luminance with the same electric power consumption as in a case where such a peak luminance increasing control is carried out while maintaining the background luminance.

Here, the light intensity determining section 22 determines light intensities of the respective segments 120 by (i) calculating light intensities of the respective segments 120 on the basis of a local dimming technique and then (ii) correcting the calculated light intensities such that light intensities of adjacent segments 120 do not largely differ from each other. That is, the light intensity determining section 22 corrects light intensities, with the use of the display image data and the peripheral image data, such that a difference in light intensity between the adjacent segments 120 becomes smaller by the correction. This allows the entire multi-display device 1 to display an image, in which luminance varies smoothly. Note that the process of determining light intensities will be described later in detail.

The peripheral data deleting section 23 is a block for deleting the peripheral display image data, after the light intensity determining section 22 calculates light intensities of the respective segments 120. The peripheral display image data is data of a peripheral image, which is located around the display image displayed by the liquid crystal panel 11 of the liquid crystal display device 30. That is, the peripheral image is not displayed by the liquid crystal panel 11 which displays the display image. Therefore, the peripheral display image data is not needed after the light intensities of the respective segments 120 are calculated. In view of this, the peripheral data deleting section 23 deletes the peripheral display image data as above, and therefore the storage section 26 does not need to consistently hold the peripheral display image data. This allows a reduction in capacity of the storage section 26. Further, in a case where the receiving section 21 receives peripheral non-display image data, the peripheral data deleting section 23 also deletes the peripheral non-display image data.

In a case where the receiving section 21 receives the display image data and the peripheral display image data, the peripheral display image data is not necessary for the liquid crystal panel 11 which displays the display image data. Therefore, the peripheral data deleting section 23 deletes the peripheral display image data so that only the display image data remains. Then, the display control section 20 controls the liquid crystal panel 11 to display only the display image data. Note that, in the present embodiment, the display image data and the peripheral display image data are received together by the receiving section 21. However, the present embodiment is not limited to this, and therefore the display image data and the peripheral display image data may be received separately by the receiving section 21.

In a case where the receiving section 21 receives the display image data, the peripheral display image data, and the peripheral non-display image data, the peripheral data deleting section 23 deletes the peripheral display image data and the peripheral non-display image data so that only the display image data remains. Note that, in the present embodiment, the display image data, the peripheral display image data, and the peripheral non-display image data are received together by the receiving section 21. However, the present embodiment is not limited to this, and therefore the display image data, the peripheral display image data, and the peripheral non-display image data may be received separately by the receiving section 21.

Note that, in the peripheral data deleting section 23, for example, the display image data and the peripheral display image data (or the display image data, the peripheral display image data, and the peripheral non-display image data) are once stored in a volatile storage area, and then only the display image data is subjected to a conversion of video output rate and read out from the volatile storage area.

The display control section 20 sends, to the backlight device 12, data indicative of the light intensities of the respective segments 120 determined by the light intensity determining section 22. The backlight device 12 controls the light sources 12*a* of the respective segments 120 to emit light based on the received data indicative of the light intensities of the respective segments 120. Here, the backlight device 12 controls the light sources 12*a* such that the light emitted from the segments 120 is in sync with the display image data displayed on the liquid crystal panel 11. Moreover, the display control section 20 controls the liquid crystal panel 11 to display the display image data, which has not been deleted by the peripheral data deleting section 23. In a case where, for example, the liquid crystal panel 11 is a liquid crystal panel of a TFT (Thin Film Transistor) type, the display control section 20 (i) generates, based on the display image data, a control signal and a video signal for respective of a source driver and a gate driver which drive the TFTs and then (ii) supplies the control signal and the video signal to the source driver and the gate driver, respectively.

The transmittance determining section 24 determines transmittances for the respective plurality of pixels included in the liquid crystal panel 11 of the liquid crystal display device 30. Here, the transmittance determining section 24 determines a transmittance of liquid crystal for a target pixel based on a light intensity, determined by the light intensity determining section 22, of a segment 120 which faces the target pixel. The display control section 20 controls liquid crystal for the plurality of pixels such that the liquid crystal for each of the plurality of pixels has a corresponding determined transmittance. With the configuration, it is possible to determine pixel luminances in the liquid crystal display panel 11 by combining the light intensities of the respective segments 120 and the transmittances of the liquid crystal. This allows a reduction in light intensities of the respective segments 120. It is therefore possible to further reduce average electric power consumption of the multi-display device 1.

The detecting section 25 detects whether or not the receiving section 21 has received the peripheral display image data. In a case where the detecting section 25 determines that the receiving section 21 has not received the peripheral display image data, the light intensity determining section 22 determines light intensities of the respective segments 120 such that (i) a lowest one of light intensities of all the segments 120 of the backlight device 12 included in the liquid crystal display device 30 does not become zero or (ii) a lowest one of light intensities of segments 120 in the vicinity of the panel border bezels 111 does not become zero. With the configuration, it is possible to display an image while suppressing a floating black level around a high luminance object in the image, even in a case where the receiving section 21 has not received the peripheral display image data.

In this case, at least segments 120 in the vicinity of the panel border bezels 111 (slightly) emit light for maintaining a background luminance, and therefore (i) all the entire liquid crystal panels 11 are slightly brightened (see FIG. 14) or (ii) the vicinity of the panel border bezels 111 is slightly brightened.

Here, the receiving section 21 receives, as black image data or data having no image, the peripheral non-display image data indicative of an image which is contiguous to the display image but is not displayed on any of the liquid crystal panels 11 of the respective liquid crystal display devices 30. Therefore, even if the light intensity determining section 22 determines light intensities of the respective segments 120 with the use of the peripheral non-display image data, the peripheral non-display image data does not affect the determination of the light intensities of the respective segments 120, since the peripheral non-display image data is the black image data or the data having no image. This makes it possible to prevent the peripheral non-display image data from being used to determine the light intensities of the respective segments 120.

The peripheral non-display image data is indicative of the image outside of a bezel of the liquid crystal panel 11, which bezel does not abut on any of the other liquid crystal panels 11. That is, the peripheral non-display image data (i) is indicative of the image outside of a bezel (outermost bezel) 112, which corresponds to an outer frame of the multi-display device 1, and (ii) is not necessary for determining the light intensities of the respective segments 120. That is, even in a case where the peripheral non-display image data contains data of an image with high luminance, this image does not need to be considered for determining the light intensities of the respective segments 120 because the image will not be displayed. Note that the peripheral non-display image data may contain image size information and information indicative of an area for displaying image, with which pieces of information the peripheral non-display image data can be recognized as data of image not to be displayed.

Alternatively, the light intensity determining section 22 may be configured to determine light intensities without using the peripheral non-display image data, even in a case where the peripheral non-display image data has been received by the receiving section 21. This configuration can be achieved by setting, in advance, each of the receiving sections 21 to recognize which sides of a corresponding liquid crystal panel 11 abut on adjacent liquid crystal panels 11.

According to the configuration, the peripheral non-display image data is not used to determine the light intensities of the respective segments 120. This allows the light intensities of the respective segments 120 to be determined without carrying out an unnecessary process.

Note that the liquid crystal display device 30 of the present embodiment is not limited to a liquid crystal display device which constitutes a part of the multi-display device 1 from the beginning. That is, the liquid crystal display device 30 of the present embodiment may be a liquid crystal display device which can be used as a part of the multi-display device 1 later. In such a case, the liquid crystal display device 30 (i) has outermost bezels 112 corresponding to four sides of the liquid crystal display device 30, and (ii) serves as a liquid crystal display device in which ordinary local dimming for a single liquid crystal display device is carried out. That is, the liquid crystal display device 30 of the present embodiment can be used as a single liquid crystal display device which can be used to constitute a part of the multi-display device 1 later so as to attain the object of the present invention in combination with the other liquid crystal display devices 30.

The following description will discuss details of processes carried out by the light intensity determining section 22 for determining light intensities of the respective segments 120. Note that the description below discusses processes carried out in a case where a single image (large image) is displayed by all the liquid crystal panels 11 of the liquid crystal display devices 30 constituting the multi-display device 1.

(Determination of Light Intensity and Transmittance of Liquid Crystal)

Figure 4:
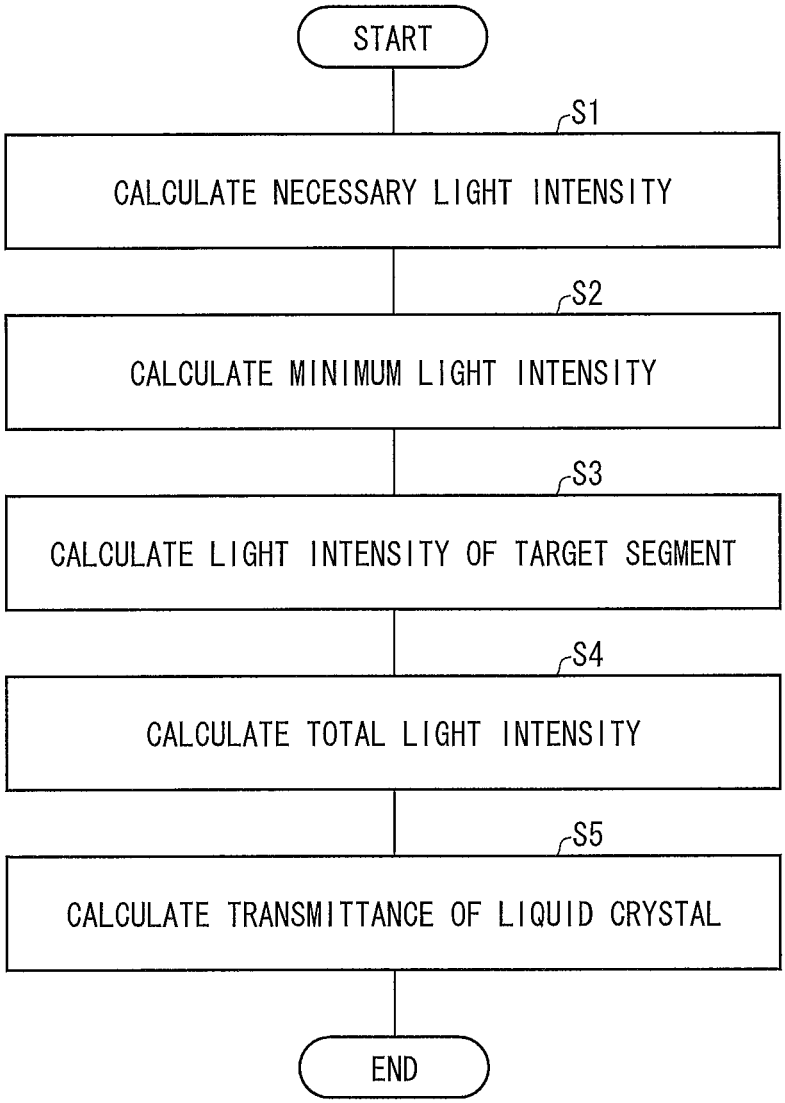
FIG. 4 is a view illustrating a flow of processes for determining light intensity and a transmittance of liquid crystal.

First, the following describes processes (i) for determining a light intensity of a segment 120 (hereinafter, referred to as "target segment 120*a*") whose light intensity is to be determined and (ii) for determining transmittance of liquid crystal for pixels belonging to the target segment 120*a*, with reference to a flowchart illustrated in FIG. 4.

In a first step (S1), a necessary light intensity of the target segment 120*a* is calculated. The necessary light intensity is calculated by the use of a statistic (such as an average, a median, or a largest value) of luminance components of an image displayed in an area 110 (hereinafter, referred to as "target area 110*a*") corresponding to the target segment 120*a*. In the present embodiment, the necessary light intensity is calculated by the use of a largest value among the luminance components. Note that, in this specification, the single word "luminance" means a scale of brightness (e.g., a photometric value) of an actually displayed image. On the other hand, the term "luminance component" means a value indicative of brightness of image, which brightness is calculated based on image data.

In the present embodiment, each of the segments 120 faces an area 110 made up of 57 pixels×64 pixels in the liquid crystal panel 11. Under the circumstances, the necessary light intensity is determined by the use of a largest value among luminance components of respective 3648 pixels (=57 pixels×64 pixels), which constitute the target area 110*a* corresponding to the target segment 120*a*. A luminance component Y of each pixel is calculated by using pixel values indicated as 8-bit values of RGB, as follows:

$$Y=0.2126R+0.7152G+0.0722B$$

In a second step (S2), minimum light intensities are calculated for respective of the target segment 120*a* and segments 120 (hereinafter, referred to as "peripheral segment 120*aa*") around the target segment 120*a*. Specifically, minimum light intensities of respective of the target segment 120*a* and the peripheral segments 120*aa* are defined with respect to the necessary light intensity of the target segment 120*a*. Note that the peripheral segments 120*aa* are a plurality of segments located around the target segment 120*a*.

Light emitted from the light source 12*a* is controlled for each of colors RGB in each pixel by controlling a corresponding transmittance of liquid crystal. However, light-shielding property of liquid crystal is limited, and therefore light transmission cannot be completely prevented by the control of the liquid crystal. Since the light is transmitted as such, a difference in black level is caused between (i) one area 110 corresponding to a light-emitting segment 120 and (ii) another area 110 corresponding to a non-light-emitting segment 120, even though RGB values in both the one area 110 and the another area 110 are zero. In order to deal with such a phenomenon, in the step S2, a light intensity is calculated, based on the necessary light intensity, for causing the target segment 120*a* and the peripheral segments 120*aa* to slightly emit light so that such a difference in black level is hardly recognized. Moreover, the process of the step S2 is carried out in order to complement the light intensity of the target segment 120*a* by utilizing light (peripheral light) emitted by the peripheral segments 120*aa*.

Specifically, with respect to the necessary light intensity (in the present embodiment, 256 levels between 0 and 255) of the target segment 120*a*, minimum light intensities of respective 7×7 segments (i.e., the target segment 120*a* and the peripheral segments 120*aa*) centered on the target segment 120*a* are stored in the storage section 26 (e.g., a nonvolatile memory) in advance. Then, the minimum light intensities, corresponding to the necessary light intensity of the target segment 120*a*, of respective of the target segment 120*a* and the peripheral segments 120*aa* are read out from the storage section 26.

FIG. 5 is a view illustrating an example of minimum light intensities of respective of the target segment 120*a* and the peripheral segments 120*aa*, in a case where the necessary light intensity of the target segment 120*a* is 255. FIG. 6 is a view illustrating an example of minimum light intensities of respective of the target segment 120*a* and the peripheral segments 120*aa*, in a case where the necessary light intensity of the target segment 120*a* is 64. In FIGS. 5 and 6, a value located at (x, y) indicates a minimum light intensity of the target segment 120*a*, and values located other than (x, y) indicate minimum light intensities of the respective peripheral segments 120*aa*.

Those minimum light intensities are, in advance, (i) calculated by (a) combining the backlight device 12 with the liquid crystal panel 11 and (b) measuring luminances of surfaces of respective areas 110 with respect to light intensities of the respective segments 120, and then (ii) stored in the storage section 26 as characteristic values. Alternatively, in a case where the segments 120 are uniformly arranged, the minimum light intensities are approximated to Gaussian distribution, and therefore the minimum light intensities may be calculated as needed based on coefficients of the Gaussian distribution, which have been stored in the storage section 26 as characteristic values.

In a third step (S3), the light intensity of the target segment 120*a* is calculated. The light intensity of the target segment 120*a* is defined by a largest light intensity among the minimum light intensities assigned to respective of the target segment 120*a* and the peripheral segments 120*aa*. That is, a largest light intensity among the minimum light intensities assigned to a maximum of 49 segments 120 (including the target segment 120*a*) is set to the light intensity of the target segment 120*a*. The light intensity of the target segment 120*a* is calculated for each of all the segments 120 contained in the liquid crystal display device 30. Note that the backlight device 12 controls the light sources 12*a* of the respective segments 120 so that the segments 120 have the respective light intensities which have been calculated as above described.

In a fourth step (S4), a total light intensity of the target segment 120*a* is calculated. The "total light intensity" is an intensity of light which is actually emitted outside through the target area 110*a* corresponding to the target segment 120*a*. Specifically, the total light intensity is calculated by carrying out a convolution operation with respect to the light intensities of the respective 7×7 segments (i.e., the target segment 120*a* and the peripheral segments 120*aa*) centered on the target segment 120*a*. In this case, coefficients used in the convolution operation are, in advance, (i) calculated by (a) combining the backlight device 12 with the liquid crystal panel 11 and (b) measuring luminances of surfaces of respective areas 110 with respect to the light intensities of the respective segments 120, and then (ii) stored in the storage section 26 as characteristic values.

FIG. 7 is a view illustrating an example of coefficients used to carry out the convolution operation. In the present embodiment, "a" in FIG. 7 is "1275".

In a fifth step (S5), transmittances of liquid crystal for the respective pixels are determined (calculated). A transmittance for a pixel (target pixel) is calculated based on a total light intensity of a segment 120 facing the target pixel. In other words, the transmittance for the target pixel is calculated, based on the total light intensity of the segment 120 to which the target pixel belongs, such that light necessary for each of the colors RGB is transmitted. Then, the display control section 20 controls the liquid crystal of the pixels so that the liquid crystal of the pixels has transmittances calculated for the respective pixels.

(In Case where Extended Image is Received)

The following description will discuss a case where (i) the liquid crystal panel 11A of the liquid crystal display device 30A and the liquid crystal panel 11B of the liquid crystal display device 30B are adjacent to each other via the panel border bezel 111 in the multi-display device 1 (see FIG. 8) and (ii) a light intensity of the target segment 120*a* included in the liquid crystal display device 30A is calculated. In a lower figure in FIG. 8, grids depicted with dotted lines indicate segments 120, which are provided in back of the liquid crystal panel 11. The same applies to FIGS. 9 through 11.

Figure 8:
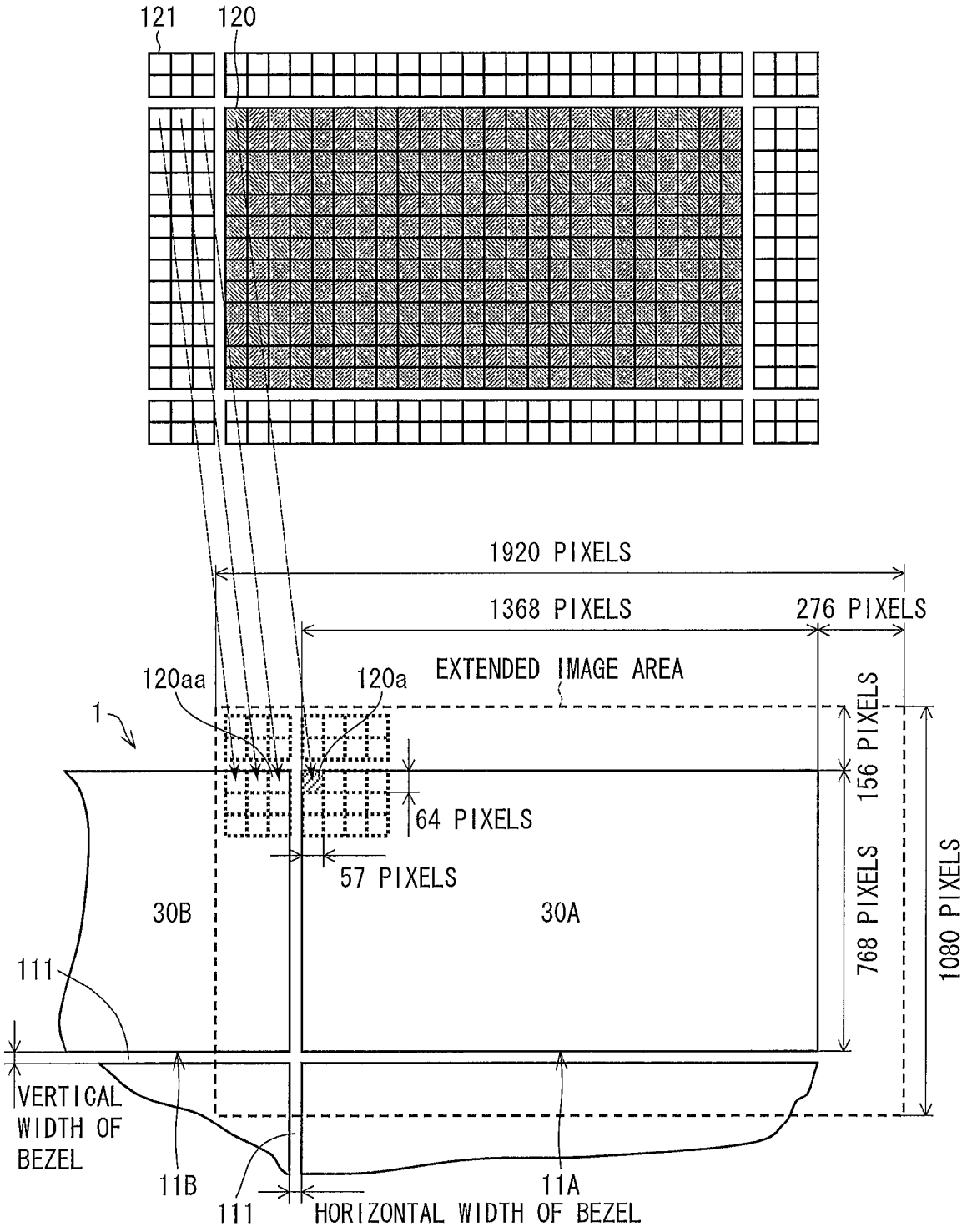
FIG. 8 is a view for explaining a case where peripheral display image data is used to determine a light intensity of a target segment.

In the configuration shown in FIG. 8, the target segment 120*a* is included in the liquid crystal display device 30A, and some of the peripheral segments 120*aa* are included in the liquid crystal display device 30B but are located next to the target segment 120*a* via the panel border bezel 111. In a case where a pixel with high luminance exists in an area corresponding to the peripheral segments 120*aa* in the liquid crystal display device 30B, the target segment 120*a* needs to slightly emit light so that a difference in black level between an area corresponding to the target segment 120*a* and the area corresponding to the peripheral segments 120*aa* is hardly recognized, even though a necessary light intensity of the target segment 120*a* is zero. This control requires information regarding an imaged to be displayed on the liquid crystal panel 11B.

In view of this, the receiving section 21 receives, from outside, data of an extended image (made up of a display image and a peripheral image) having a size of 1920 pixels× 1080 pixels, instead of the display image which is to be displayed on the liquid crystal panel 11A and has a size of 1368 pixels×768 pixels. Note that the number of pixels above is described merely as an example. The extended image contains a partial image (peripheral display image) which is to be displayed on the liquid crystal panel 11B. In the lower figure in FIG. 8, the extended image is indicated as an area outlined by dotted lines. In the description below, it is assumed that the extended image, the display image, and the peripheral image have been processed by the receiving section 21 so as to accord with a resolution of the liquid crystal panel 11.

Then, with respect to the extended image, segments (hereinafter, referred to as "virtual segment 121") which are not actually included in the liquid crystal panel 10A are virtually prepared, and light intensities of the virtual segments 121 are determined. In an upper figure in FIG. 8, a shaded grid indicates segments 120 corresponding to the display image, i.e., the segments 120 actually included in the liquid crystal panel 10A, and blank grids indicate the virtual segments 121. That is, the virtual segments 121 correspond to the peripheral image. The virtual segments 121 include segments corresponding to segments 120, which are actually included in the liquid crystal display device 30B. The segments corresponding to the segments 120 of the liquid crystal display device 30B correspond to the peripheral display image contained in the peripheral image.

In the present embodiment, a width of the panel border bezel 111 (i.e., each distance between the liquid crystal panels 11) corresponds to a length defined by 6 pixels. Moreover, two rows of virtual segments 121 are provided on each of upper and lower sides of the segments 120 which are actually included in the liquid crystal display device 30A and three columns of virtual segments 121 are provided on each of right and left sides of the segments 120 (see the upper figure in FIG. 8). Note that a reason why only two lines of the virtual segments 121 are provided on each of upper and lower sides of the segments 120 in FIG. 8 is because only coefficients in a range of horizontal 7 segments×vertical 5 segments are used (i) in the calculation of the minimum light intensity in the step S2 and (ii) in the convolution operation in the step S4. In other words, the calculation of the light intensity of the target segment 120*a* requires only (i) two lines of peripheral segments above the target segment 120*a* and (ii) two lines of peripheral segments below the target segment 120*a*.

Light intensities of respective of (i) all the segments 120 of the liquid crystal display device 30A and (ii) the virtual segments 121 are determined (refer to the steps S1 through S4).

When the light intensities are determined, effects of the peripheral segments 120*aa* on the target segment 120*a* vary depending on difference in distance between each of the peripheral segments 120*aa* and the target segment 120*a*, which difference is caused by the width of the panel border bezel 111. By taking into consideration this, information regarding minimum light intensities of respective of the segments, including the virtual segments 121, is stored in the storage section 26 (e.g., a nonvolatile memory) in advance. Alternatively, the minimum light intensities may be calculated as needed, by the used of (i) approximate Gaussian distribution coefficients stored in the storage section 26 and (ii) widths of respective four panel border bezels 111 surrounding all four sides of the liquid crystal panel 11.

This allows determination of the light intensity of the target segment 120*a*, while considering the minimum light intensities of the peripheral segments 120*aa*. It is therefore possible to obtain a result similar to that obtained in a case where light intensity information is shared by the liquid crystal display panels 30 adjacent to each other via the panel border bezel 111. This makes it possible to control the light intensities so that a difference in black level between adjacent liquid crystal display devices 30 is hardly recognized. In the case where the light-emitting object 3 (which is an image having high luminance) resides in a peripheral display image displayed on the liquid crystal panel 11B around the liquid crystal panel 11A (see FIG. 13), it is possible to prevent a floating black level around the light-emitting object 3 from becoming conspicuous.

Figure 9:
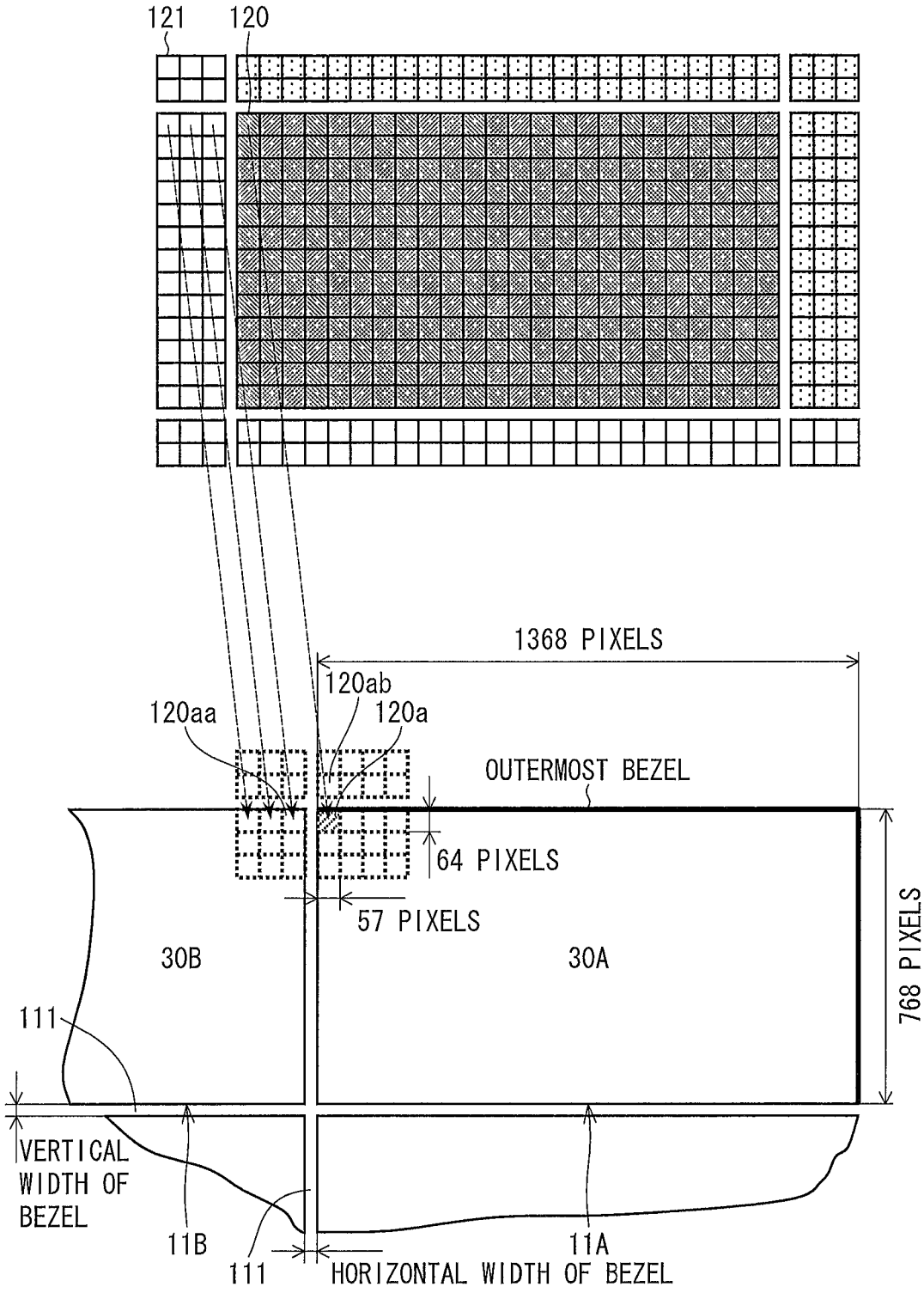
FIG. 9 is a view for explaining a case where a light intensity of a target segment is determined without using peripheral non-display image data.

The following description will discuss assignment (allocation) of minimum light intensities of respective peripheral segments 120*ab* to the target segment 120*a* (see FIG. 9). The peripheral segments 120*ab* correspond to an image (part of a peripheral non-display image) which is not displayed on any of the liquid crystal panels 11.

In this case, the peripheral image data is to contain data of a peripheral non-display image, which (i) includes the image corresponding to the peripheral segments 120*ab* and (ii) is not displayed on any of the liquid crystal panels 11, and such data of the peripheral non-display image is received as black image data. This makes it possible to avoid incorrect determination of light intensities. In an upper figure in FIG. 9, dotted grids indicate virtual segments corresponding to the black image (i.e., peripheral non-display image).

Instead of receiving the peripheral non-display image data as the black image data, it is possible to avoid incorrect determination of light intensities by setting outermost bezel information as follows. That is, outermost bezel information is set for indicating that an upper side and a right side of the liquid crystal panel 11A are outermost bezels 112, i.e., the upper side and the right side of the liquid crystal panel 11A are set in advance to be sides which do not abut on any of the other display panels 11. In this case, the peripheral segments 120*ab* correspond to an area of a display panel which does not actually exist. Therefore, it is not necessary to consider a difference in black level from the peripheral segments 120*ab*. Therefore, the light intensity of the target segment 120*a* is determined without considering minimum light intensities assigned from virtual segments 121 (corresponding to the peripheral segments 120*ab* in FIG. 9), which exist outer side of the outermost bezels. This makes it possible to avoid unnecessary assignments of minimum light intensities. This allows avoidance of incorrect determination of light intensities.

Alternatively, instead of receiving the peripheral non-display image data as the black image data, it is possible to set outermost bezel information so as to consider the peripheral non-display image as a black display as follows. According to the configuration, an image, which corresponds to virtual segments existing outer side of the outermost bezel 112, is considered as a black display (see FIG. 10 (*a*)). By considering the image as such, the light intensity of the target segment 120*a* is to be calculated while the virtual segments, existing outer side of a side to which the outermost bezel information has been set, are considered as displaying a black image. This is equivalent to the configuration in which the light intensity of the target segment 120*a* is determined without considering minimum light intensities assigned from virtual segments 121 existing outer side of the outermost bezels.

(In Case of Insufficient Virtual Segments)

Figure 11:
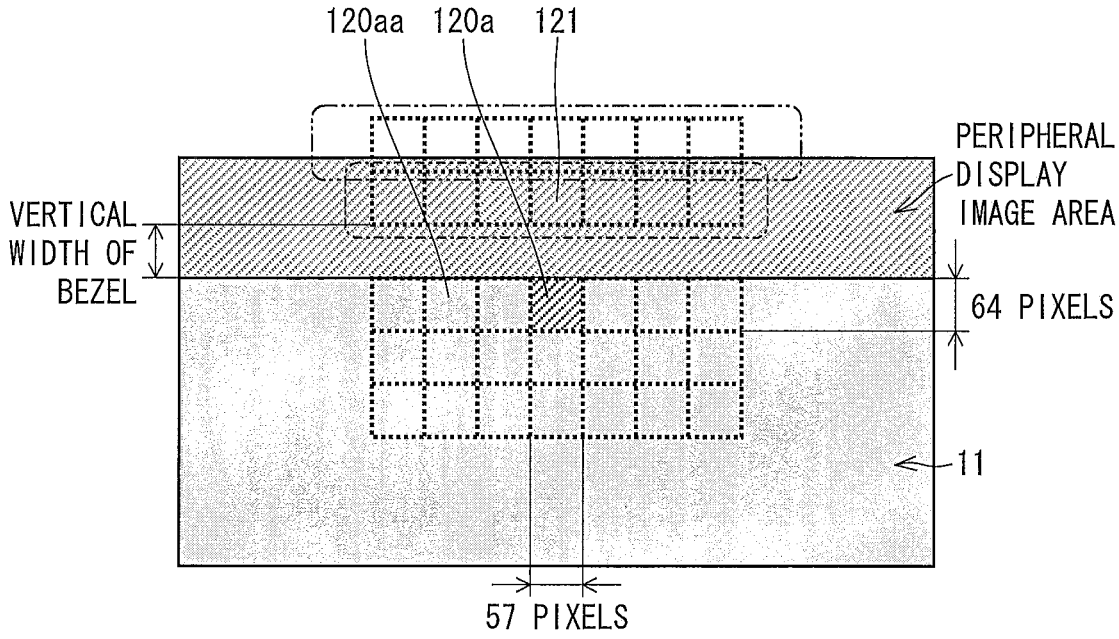
FIG. 11 is a view for explaining a case where virtual segments can be set in a part of a received extended image but cannot be set in another part of the received extended image, when a light intensity of a target segment is determined.

The following description will discuss a process carried out in a case where virtual segments cannot be secured sufficiently as peripheral segments for a target segment 120*a* in the vicinity of the bezel (see FIG. 11). Such a case occurs, for example, when (i) the receiving section 21 receives an extended image having a size larger than 1368 pixels×768 pixels but smaller than 1722 pixels×1036 pixels or (ii) a center of an extended image having a size of 1722 pixels×1036 pixels does not coincide with a center of the liquid crystal panel 11. In such a case, a light intensity of the target segment 120*a* is determined while an image corresponding to lacking virtual segments is considered as a white image (considered white image). With regard to secured virtual segments, of course, an image corresponding to the secured virtual segments is used. In FIG. 11, a grid surrounded by a two-dot chain line indicates the lacking virtual segments and a grid surrounded by a chain line indicates the secured virtual segments.

In the present embodiment, whether or not virtual segments can be set is judged after data of an extended image received by the receiving section 21 is processed to accord with the resolution of the liquid crystal panel 11. Note, however, that, the same result can be obtained by judging, by merely taking into consideration the resolution, whether or not virtual segments can be set for a size of the received extended image.

Note that virtual segments may be set as follows: that is, virtual segments corresponding to a peripheral image are set only in a case where the receiving section 21 receives data of an extended image in which necessary virtual segments (i.e., in the present embodiment, two lines of virtual segments 121 provided on each of upper and lower sides of the segments 120 actually included in the liquid crystal display device 30 and three lines of virtual segments 121 provided on each of right and left sides of the segments 120) can be set for determining light intensities of the respective segments 120 actually included in the liquid crystal display device 30; and virtual segments are not set at all in a case where sufficient virtual segments cannot be set. In the case where virtual segments are not set at all, the same process is carried out as that of a case where any peripheral image data is received, which case will be described below.

(In Case where No Peripheral Image Data is Received)

The following description will discuss a case where (i) the liquid crystal panel 11A of the liquid crystal display device 30A and the liquid crystal panel 11B of the liquid crystal display device 30B are adjacent to each other via the panel border bezel 111 in the multi-display device 1 (see FIG. 9) and (ii) the receiving section 21A of the liquid crystal display device 30A receives, from outside, only data of an image having a size identical with that of the liquid crystal panel 11A or it is determined from a size of the received image that no peripheral image exists.

In this case, information of the peripheral segments 120*aa* in the liquid crystal display device 30B cannot be used to determine the light intensity of the target segment 120*a*. In view of this, the light intensity of the target segment 120*a* is determined by using virtual information of light intensities of the respective peripheral segments 120*aa* in the liquid crystal display device 30B. In this case, a minimum light intensity of the target segment 120*a* is calculated based on the assumption that necessary light intensities of the respective peripheral segments 120*aa* in the liquid crystal display device 30B are 255. From the viewpoint of the liquid crystal display device 30B, a minimum light intensity of the peripheral segment 120*aa* (which is a target segment for the liquid crystal display device 30B) is calculated similarly based on the assumption that necessary light intensities of the target segments 120*a* (which are peripheral segments for the liquid crystal display device 30B) are 255.

Figure 10:
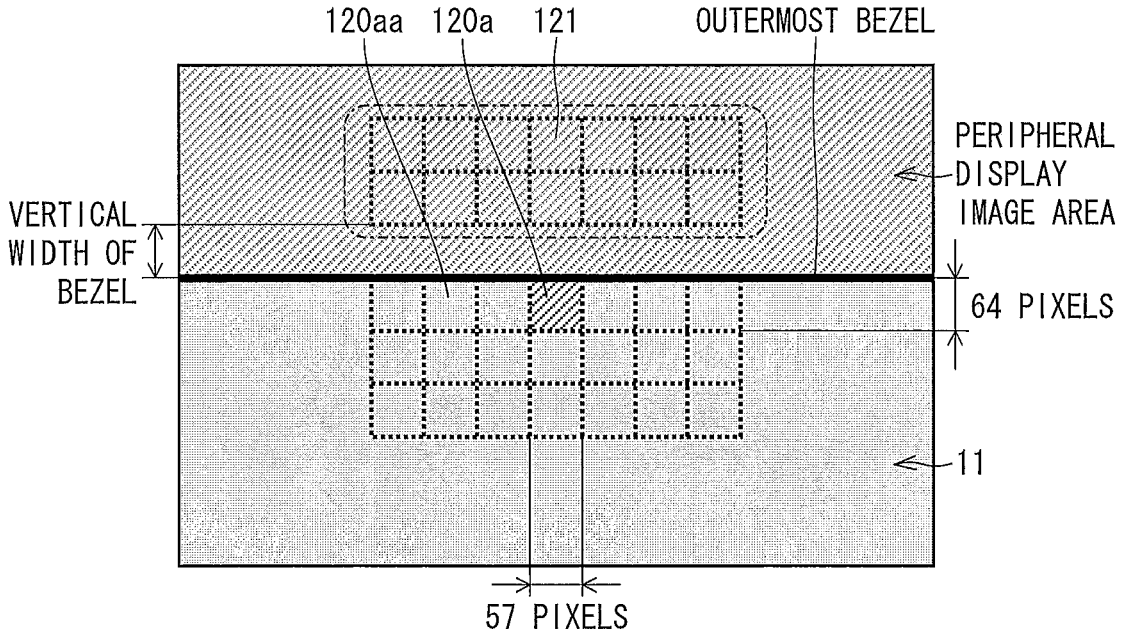
FIG. 10 (*a*) is a view for explaining a case where outermost bezel information is set when a light intensity of a target segment is determined.
Figure 10:
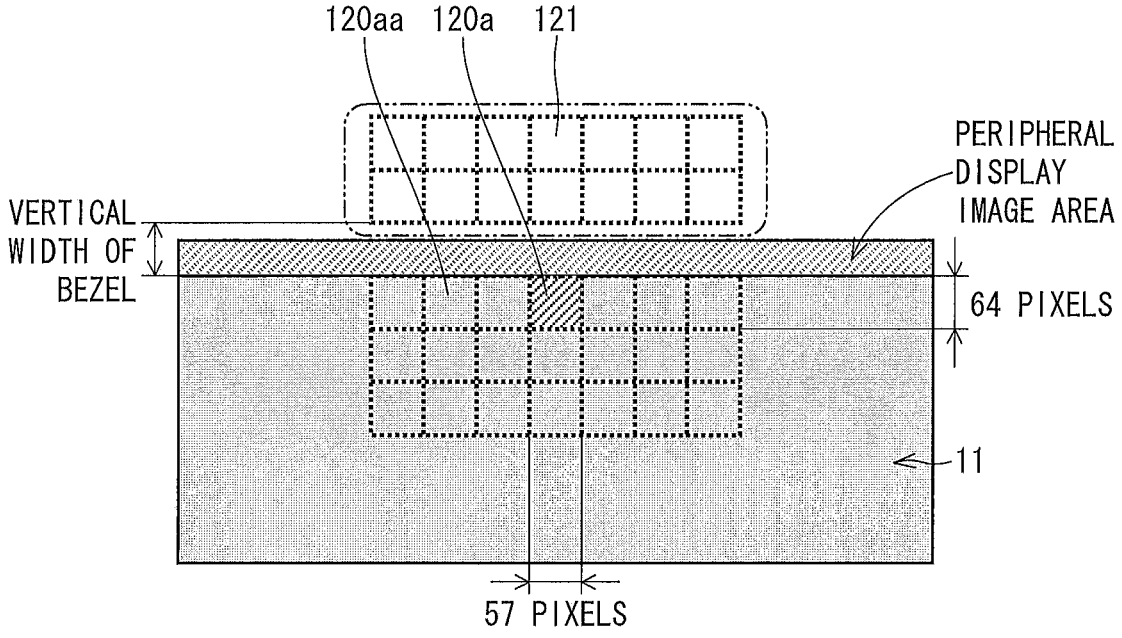

Specifically, an image corresponding to the virtual segments 121 is considered as a white display (see FIG. 10 (*b*)). In such a case, when the light intensity of the target segment 120*a* is calculated by carrying out the convolution operation with respect to the light intensities of the respective 7×7 segments centered on the target segment 120*a* as early described for the step S4, some of the 7×7 segments are considered as segments for the white display. Therefore, the light intensity of the target segment 120*a* does not become zero. Consequently, segments adjacent to the virtual segments are to consistently emit weak light. With the configuration, a difference in black level between the adjacent liquid crystal display devices 30 is hardly recognized (see FIG. 14).

In the step S4, the convolution operation is carried out. In view of this, if an offset value is set in a calculation formula, the total light intensity of the target segment 120*a* does not become zero, even in a case where a black image is displayed in the target area 110*a* corresponding to the target segment 120*a*. This allows the target area 110*a* to be slightly brightened, even though the target area 110*a* is not in the vicinity of the bezels. It is therefore possible to set a lowest one of light intensities of respective of the target segment 120*a* and the peripheral segments 120*aa* to be set to be higher than zero. With the above control, the segments 120 are controlled not to be turned off completely. This control is useful to suppress a visible difference between (i) a black display of an area 110 when a corresponding segment 120 is turned on and (ii) a black display of the area 110 when the corresponding segment 120 is turned off.

Figure 14:
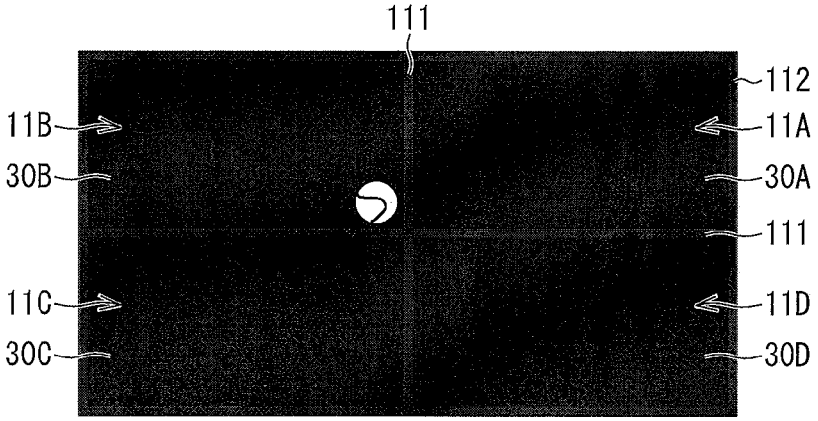
FIG. 14 is a view illustrating an example of a display carried out while a background luminance is maintained.
Figure 15:
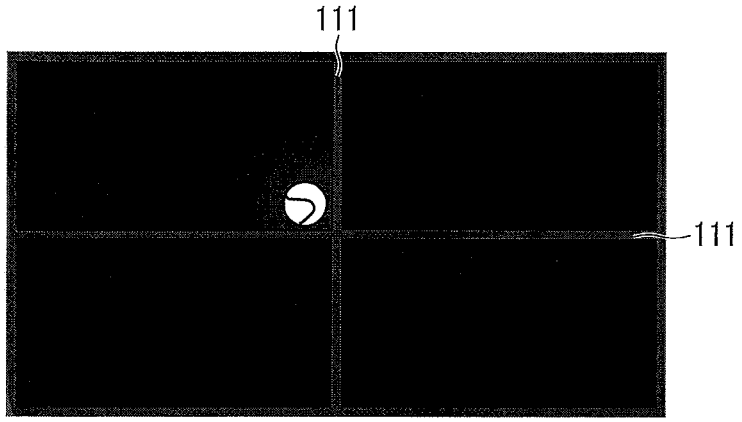
FIG. 15 is a view illustrating an example in which an image of a light-emitting object is displayed by a conventional multi-display device.

In the process above described, all the segments 120 or at least segments 120 in the vicinity of the panel border bezels 111 (slightly) emit light for maintaining a background luminance (see FIG. 14). This causes a difference in background in the vicinity of the panel border bezels 111 to be hardly viewed. Moreover, when information of outermost bezels 112 is set to four sides of the display panel 11, a local dimming process can be carried out by one (1) liquid crystal display device 30.

(Program and Storage Medium)

The display control section 20 of the liquid crystal display device 30 above described can be configured by hardware logic or realized by software with the use of CPU as follows.

That is, the display control section 20 includes a CPU (central processing unit), a ROM (read only memory), a RAM (random access memory), and a storage device (storage medium) such as a memory. The CPU executes instructions of control programs for realizing the functions of the display control section 20. In the ROM, the programs are stored. Into the RAM the programs are loaded. In the storage device, the programs and various data are stored. The objective of the present invention can also be achieved, by (i) supplying a storage medium, in which program codes (executable programs, intermediate code programs, source programs) of programs for controlling the display control section 20 configured by software for realizing the functions, are stored so that a computer can read them, to the display control section 20, and then (ii) causing the computer (or CPU or MPU) to read and execute the program codes stored in the storage medium.

The storage medium can be, for example, a tape, such as a magnetic tape or a cassette tape; a disk including (i) a magnetic disk such as a floppy (Registered Trademark) disk or a hard disk and (ii) an optical disk such as CD-ROM, MO, MD, DVD, or CD-R; a card such as an IC card (memory card) or an optical card; or a semiconductor memory such as a mask ROM, EPROM, EEPROM, or flash ROM.

Alternatively, the display control section 20 can be arranged to be connected to a communications network so that the program codes are delivered over the communications network. The communications network is not limited to a specific one, and therefore can be, for example, the Internet, an intranet, extranet, LAN, ISDN, VAN, CATV communications network, virtual private network, telephone line network, mobile communications network, or satellite communications network. The transfer medium which constitutes the communications network is not limited to a specific one, and therefore can be, for example, wired line such as IEEE 1394, USB, electric power line, cable TV line, telephone line, or ADSL line; or wireless such as infrared radiation (IrDA, remote control), Bluetooth (Registered Trademark), 802.11 wireless, HDR (high data rate), mobile telephone network, satellite line, or terrestrial digital network. Note that, the present invention can be realized by a computer data signal (i) which is realized by electronic transmission of the program code and (ii) which is embedded in a carrier wave.

(Configuration of Present Invention)

As above described, the liquid crystal display device of the present invention is a liquid crystal display device for use in a multi-display device made up of a plurality of liquid crystal display devices set in array, the liquid crystal display device includes: a display panel for displaying an image; a backlight device which is provided in back of the display panel and is divided into segments having respective light sources, the backlight device being capable of illuminating at light intensity adjustable for each of the segments; a receiving section for receiving image data indicative of an image to be displayed on the display panel; and a light intensity determining section for determining a light intensity at which the backlight device illuminates for each of the segments of the backlight device, in a case where the receiving section receives peripheral display image data, the light intensity determining section determining the light intensity of each of the segments based on the image data and the peripheral display image data, the peripheral display image data being indicative of an image, which (i) is contiguous to the image to be displayed on the display panel and (ii) is to be displayed on at least part of a display panel of a liquid crystal display device provided around the liquid crystal display device among the plurality of liquid crystal display devices for use in the multi-display device.

According to the configuration, the liquid crystal display device for use in the multi-display device determines light intensities of the respective segments with the use of the image data of the image to be displayed on the display panel of the liquid crystal display device and the peripheral display image data. The peripheral display image data (i) is contiguous to the image to be displayed on the display panel and (ii) is to be displayed on at least part of the at least one display panel which is provided in the respective at least one other liquid crystal display device, which is a device for use in the multi-display device and is provided around the liquid crystal display device. With the configuration, it is possible to determine light intensities such that a difference of light intensities does not become too large (i) between adjacent segments in one (1) liquid crystal display device or (ii) between adjacent segments across adjacent liquid crystal display devices. In a case where, for example, an object with high luminance is contained in the peripheral display image, light intensities of the segments of the backlight device included in the liquid crystal display device can be determined such that a floating black level around the object with high luminance does not become conspicuous.

This makes it possible to suppress a large difference in brightness (i) between adjacent areas in a display panel of one (1) liquid crystal display device or (ii) between adjacent areas across display panels of liquid crystal display devices adjacent to each other, even in a case where the adjacent areas, which face respective segments adjacent to each other, display respective partial images having identical or similar averages, etc. of luminance components. This prevents the multi-display device, in which the plurality of liquid crystal display devices are set in array, from displaying an image that appears unnatural.

Note that the "area" is provided in the display panel, and corresponds to each of the segments. That is, the display panel is divided into areas whose number is identical with that of the segments.

Here, in order to display a natural image as the entire multi-display device, it may be possible to employ a method as follows: that is, segments in the vicinity of the bezels (panel border bezels), which correspond to boundaries between the liquid crystal display devices in the multi-display device, are caused to (slightly) emit light to maintain a background luminance (see FIG. 14), so that a difference in background is hardly viewed in the vicinity of the panel border bezel 111. This method can be carried out merely by causing the segments in the vicinity of the panel border bezels not to be turned off completely. Moreover, this method can be carried out by using only the image data to be displayed on the display panel. Therefore, this method can be carried out easily.

However, in the case where the backlight luminance is maintained by such a method, average electric power consumption of the entire multi-display device will be increased. Further, since at least the segments in the vicinity of the panel border bezels are emitting light, a contrast ratio will be decreased. It is therefore impossible to conspicuously display an image of a light-emitting object, which is displayed in the vicinity of the panel border bezels. Note that, in the example shown in FIG. 14, not only the segments in the vicinity of the panel border bezels 111, but also all the segments in the multi-display device slightly emit light for maintaining the background luminance.

On the other hand, in the liquid crystal display device of the present invention, light can be emitted by only necessary segments. This allows suppression of average electric power consumption of the multi-display device, as compared to the case where the background luminance is maintained by causing at least the segments to emit light in the vicinity of the panel border bezels. Moreover, even in the vicinity of the panel border bezels, it is possible to cause (i) an area for displaying a bright image to be brighter and (ii) another area for displaying a dark image to be darker. It is therefore possible to display an image with a higher contrast ratio of bright and dark, as compared to the case where the background luminance in the vicinity of the panel border bezels is maintained.

Moreover, according to the liquid crystal display device of the present invention, it is not necessary to maintain the background luminance by causing segments to emit light in the vicinity of the panel border bezels, unlike the case where a background luminance is maintained by causing the segments to slightly emit light in the vicinity of the panel border bezels. With the configuration, electric power can be consumed by segments (whose number is smaller than that of the segments in the vicinity of the panel border bezels) for emitting light at maximum output, instead of being consumed for maintaining the background luminance. Therefore, in a case where a peak luminance increasing control is carried out for causing a part of the segments to emit light with a luminance higher than that of light emitted by all the segments, it is possible to further heighten the peak luminance with the same electric power consumption as in a case where such a peak luminance increasing control is carried out while maintaining the background luminance.

In the liquid crystal display device or the present invention, the light intensity determining section may determine light intensities of adjacent ones of the segments in such way that the light intensity determining section corrects the light intensities such that a difference between the light intensities of the adjacent ones of the segments becomes smaller by the correction.

With the configuration, the light intensities can be determined by correcting the light intensities such that the light intensities of adjacent segments do not excessively differ from each other. This allows the entire multi-display device to display an image, in which luminance varies smoothly.

The liquid crystal display device of the present invention may further include a peripheral data deleting section for deleting the peripheral display image data after the intensity determining section determines the light intensity of each of the segments.

The peripheral display image data is data of a peripheral image, which is located around the display image displayed by the liquid crystal panel of the liquid crystal display device. That is, the peripheral image is not displayed by the liquid crystal panel which displays the display image. Therefore, the peripheral display image data is not needed after the light intensities of the respective segments are calculated. In view of this, the peripheral data deleting section deletes the peripheral display image data as above, and therefore the peripheral display image data does not need to be held. This allows a reduction in capacity of the storage section, which stores data.

The liquid crystal display device of the present invention may further include: a transmittance determining section for determining a transmittance for each of a plurality of pixels included in the display panel of the liquid crystal display device, the transmittance determining section determining a transmittance of liquid crystal for a target pixel based on a light intensity, which has been determined by the light intensity determining section, of one of the segments which one faces the target pixel.

According to the configuration, the transmittance of liquid crystal for the target pixel is determined based on the light intensity, determined by the light intensity determining section, of the segment which faces the target pixel. The liquid crystal for the plurality of pixels is controlled such that the liquid crystal for each of the plurality of pixels has a corresponding determined transmittance. With the configuration, it is possible to determine pixel luminances in the display panel by combining the light intensities of the respective segments and the transmittances of the liquid crystal. It is therefore possible to further reduce average electric power consumption of the multi-display device.

The liquid crystal display device of the present invention may further include: a detecting section for detecting whether or not the receiving section has received the peripheral display image data, in a case where the detecting section determines that the receiving section has not received the peripheral display image data, the light intensity determining section determining the light intensity of each of the segments such that (i) a lowest one of light intensities of all the segments does not become zero or (ii) a lowest one of light intensities of some of the segments in the vicinity of a bezel does not become zero, the bezel being a border between the liquid crystal display device and a liquid crystal display device among the plurality of liquid crystal display devices for use in the multi-display device.

According to the configuration, in a case where the peripheral display image data is not received, light intensities of the respective segments are determined such that (i) a lowest one of light intensities of all the segments of the backlight device included in the liquid crystal display device does not become zero or (ii) a lowest one of light intensities of segments in the vicinity of the bezel does not become zero. With the configuration, it is possible to display an image while suppressing a floating black level around a high luminance object in an image, even in a case where the peripheral display image data does not exist.

In the liquid crystal display device or the present invention, it is possible that the receiving section receives peripheral non-display image data as black image data or data having no image, the peripheral non-display image data being indicative of an image which (i) is contiguous to the image to be displayed on the display panel of the liquid crystal display device and (ii) is not to be displayed on any of the plurality of liquid crystal display devices other than said liquid crystal display device. The peripheral non-display image data may contain image size information and information indicative of an area for displaying image, with which pieces of information the peripheral non-display image data can be recognized as data of image not to be displayed.

According to the configuration, even data of a peripheral image contiguous to the display image displayed on the display panel, the peripheral non-display image data indicative of an image which is not displayed on any of the at least one other liquid crystal display device is received as black image data or data having no image. Therefore, even if the light intensity determining section determines light intensities of the respective segments with the use of the peripheral non-display image data, the peripheral non-display image data does not affect the determination of the light intensities of the respective segments, since the peripheral non-display image data is the black image data or the data having no image. This makes it possible to prevent the peripheral non-display image data from being used to determine the light intensities of the respective segments.

The peripheral non-display image data is indicative of the image outside of a bezel of the liquid crystal panel, which bezel does not abut on any of the other liquid crystal panels. That is, the peripheral non-display image data (i) is indicative of the image outside of a bezel (hereinafter, referred to as "outermost bezel"), which corresponds to an outer frame of the multi-display device and (ii) is not necessary for determining the light intensities of the respective segments. That is, even in a case where the peripheral non-display image data contains data of an image with high luminance, this image does not need to be considered for determining the light intensities of the respective segments because the image will not be displayed.

In the liquid crystal display device of the present invention, in a case where the receiving section receives peripheral non-display image data, the light intensity determining section may determine the light intensity without using the peripheral non-display image data, the peripheral non-display image data being indicative of an image which (i) is contiguous to the image to be displayed on the display panel of the liquid crystal display device and (ii) is not to be displayed on any of the plurality of liquid crystal display devices other than said liquid crystal display device.

According to the configuration, the peripheral non-display image data, which is indicative of the image not to be displayed any of the display panels, is not used for determining the light intensities of the respective segments, even though the peripheral non-display image data is indicative of the image contiguous to the image to be displayed by the display panel.

The peripheral non-display image data (i) is indicative of the image outside of the outermost bezel and (ii) is not necessary for determining the light intensities of the respective segments. Therefore, by determining the light intensities of the respective segments without using the peripheral non-display image data, it is possible to determine the light intensities of the respective segments without carrying out an unnecessary process.

The liquid crystal display device of the present invention is not limited to a liquid crystal display device which constitutes a part of the multi-display device 1 from the beginning. That is, the liquid crystal display device of the present invention may be a liquid crystal display device which can be used as a part of the multi-display device later. In such a case, the liquid crystal display device of the present invention (i) has outermost bezels corresponding to four sides of the liquid crystal display device, and (ii) serves as a liquid crystal display device in which ordinary local dimming for a single liquid crystal display device is carried out. That is, the liquid crystal display device of the present invention can be used as a single liquid crystal display device which can be used to constitute a part of the multi-display device later so as to attain the object of the present invention in combination with the other liquid crystal display devices.

The multi-display device of the present invention includes, as above described, a plurality of liquid crystal display devices set in array, each of which is any of the above liquid crystal display device.

According to the configuration, the multi-display device of the present invention is made up of the plurality of liquid crystal display devices of the present invention set in array, each of which is above described. This makes it possible to prevent the multi-display device as a whole from displaying an image that appears unnatural, while suppressing electric power consumption.

The method of the present invention for determining a light intensity is, as above described, a method for determining a light intensity for each of segments of a backlight device provided in each of a plurality of liquid crystal display devices constituting a multi-display device, a target liquid crystal display device, which is any one of the plurality of liquid crystal display devices, including (i) a display panel for displaying an image and (ii) the backlight device which is provided in back of the display panel and is divided into the segments having respective light sources, the backlight device being capable of illuminating at light intensity adjustable for each of the segments, the method includes the steps of: (a) receiving image data indicative of an image to be displayed on the display panel; and (b) determining a light intensity at which the backlight device illuminates for each of the segments of the backlight device, in a case where peripheral display image data is received in the step (a), the step (b) determining the light intensity of each of the segments based on the image data and the peripheral display image data, the peripheral display image data being indicative of an image, which (i) is contiguous to the image to be displayed on the display panel and (ii) is to be displayed on at least part of a display panel of a liquid crystal display device provided around the target liquid crystal display device among the plurality of liquid crystal display devices for use in the multi-display device.

According to the method of the present invention, it is possible to provide the liquid crystal display device which prevents, when used in a multi-display device, the multi-display device as a whole from displaying an image that appears unnatural, while suppressing electric power consumption.

The sections of the liquid crystal display device of the present invention may be realized by a computer. In this case, (i) a program causing the computer to serve as the sections of the liquid crystal display device and (ii) a non-transitory computer-readable storage medium which stores the program are encompassed in the scope of the present invention.

The present invention is not limited to the embodiments, but can be altered by a skilled person in the art within the scope of the claims. An embodiment derived from a proper combination of technical means disclosed in respective different embodiments is also encompassed in the technical scope of the present invention.

INDUSTRIAL APPLICABILITY

The present invention is applicable to a multi-display device in which a plurality of liquid crystal display devices are adjacently arranged so as to display a large screen.

REFERENCE SIGNS LIST

1: Multi-display device
10: Display section
11, 11A, 11B, 11C, and 11D: Liquid crystal panel (display panel)
12: Backlight device
12*a*: Light source
20: Display control section
21: Receiving section
22: Light intensity determining section
23: Peripheral data deleting section
24: Transmittance determining section
25: Detecting section
30, 30A, 30B, 30C, and 30D: Liquid crystal display device
111: Panel border bezel
112: Outermost bezel
110: Area
120: Segment
120*a*: Target segment
120*aa*, 120*ab*: Peripheral segment
121: Virtual segment

The invention claimed is:

1. A liquid crystal display device for use in a multi-display device made up of a plurality of liquid crystal display devices set in array, said liquid crystal display device comprising:

a display panel for displaying an image;

a backlight device which is provided in back of the display panel and is divided into segments having respective light sources, the backlight device being capable of illuminating at light intensity adjustable for each of the segments;

a receiving section for receiving image data indicative of an image to be displayed on the display panel;

a light intensity determining section for determining a light intensity at which the backlight device illuminates for each of the segments of the backlight device; and a detecting section for detecting whether or not the receiving section has received the peripheral display image data, in a case where the receiving section receives peripheral display image data, the light intensity determining section determining the light intensity of each of the segments based on the image data and the peripheral display image data, the peripheral display image data being indicative of an image, which (i) is contiguous to the image to be displayed on the display panel and (ii) is to be displayed on at least part of a display panel of another liquid crystal display device provided around said liquid crystal display device among the plurality of liquid crystal display devices for use in the multi-display device, and in a case where the detecting section determines that the receiving section has not received the peripheral display image data, the light intensity determining section determining the light intensity of each of the segments such that (i) a lowest one of light intensities of all the segments does not become zero or (ii) a lowest one of light intensities of some of the segments in the vicinity of a bezel does not become zero, the bezel being a border between said liquid crystal display device and another liquid crystal display device provided around said liquid crystal display device among the plurality of liquid crystal display devices for use in the multi-display device.

2. The liquid crystal display device as set forth in claim 1, wherein:

the light intensity determining section determines light intensities of adjacent ones of the segments in such way that the light intensity determining section corrects the light intensities such that a difference between the light intensities of the adjacent ones of the segments becomes smaller by the correction.

3. The liquid crystal display device as set forth in claim 1, further comprising:

a peripheral data deleting section for deleting the peripheral display image data after the intensity determining section determines the light intensity of each of the segments.

4. The liquid crystal display device as set forth in claim 1, further comprising:

a transmittance determining section for determining a transmittance for each of a plurality of pixels included in the display panel of said liquid crystal display device, the transmittance determining section determining a transmittance of liquid crystal for a target pixel based on a light intensity, which has been determined by the light intensity determining section, of one of the segments which one faces the target pixel.

5. The liquid crystal display device as set forth in claim 1, wherein:

the receiving section receives peripheral non-display image data as black image data or data having no image, the peripheral non-display image data which (i) is contiguous to the image to be displayed on the display panel of said liquid crystal display device and (ii) is not to be displayed on any of the plurality of liquid crystal display devices other than said liquid crystal display device.

6. The liquid crystal display device as set forth in claim 1, wherein:

in a case where the receiving section receives peripheral non-display image data, the light intensity determining section determines the light intensity without using the peripheral non-display image data, the peripheral non-display image data which (i) is contiguous to the image to be displayed on the display panel of said liquid crystal display device and (ii) is not to be displayed on any of the plurality of liquid crystal display devices other than said liquid crystal display device.

7. A multi-display device comprising a plurality of liquid crystal display devices set in array, each of which is a liquid crystal display device recited in claim 1.

8. A non-transitory computer-readable storage medium which stores a program for controlling a liquid crystal display device recited in claim 1, the program causing a computer to serve as the receiving section, the light intensity determining section, and the detecting section of the liquid crystal display device.

9. A method for determining a light intensity for each of segments of a backlight device provided in a target liquid crystal display device for use in a multi-display device made up of a plurality of liquid crystal display devices, the target liquid crystal display device including (i) a display panel for displaying an image and (ii) the backlight device which is provided in back of the display panel and is divided into the segments having respective light sources, the backlight device being capable of illuminating at light intensity adjustable for each of the segments, said method comprising the steps of:

(a) receiving image data indicative of an image to be displayed on the display panel;

(b) determining a light intensity at which the backlight device illuminates for each of the segments of the backlight device; and (c) detecting whether or not peripheral display image data has been received in the step (a), in a case where the peripheral display image data is received in the step (a), the step (b) determining the light intensity of each of the segments based on the image data and the peripheral display image data, the peripheral display image data being indicative of an image, which (i) is contiguous to the image to be displayed on the display panel and (ii) is to be displayed on at least part of a display panel of another liquid crystal display device provided around the target liquid crystal display device among the plurality of liquid crystal display devices for use in the multi-display device; and in a case where it is determined m the step (c) that the peripheral display image data has not been received, the light intensity of each of the segments is determined in the step (b) such that (i) a lowest one of light intensities of all the segments does not become zero or (ii) a lowest one of light intensities of some of the segments in the vicinity of a bezel does not become zero, the bezel being a border between the target liquid crystal display device and another liquid crystal display device provided around the target liquid crystal display device among the plurality of liquid crystal display devices for use in the multi-display device.

* * * * *